United States Patent [19]

Minella et al.

[11] 4,438,717

[45] Mar. 27, 1984

[54] NEEDLE PROTECTOR FOR SEWING MACHINES

[75] Inventors: Giancarlo Minella; Bruno Motta, both of Milan; Egidio Pedone, Corsico, all of Italy

[73] Assignee: Rockwell International Corporation, Pittsburgh, Pa.

[21] Appl. No.: 268,024

[22] Filed: May 29, 1981

[30] Foreign Application Priority Data

Nov. 12, 1980 [IT] Italy ..... 25918 A/80

[51] Int. Cl.[3] ..... D05B 55/06; D05B 1/10

[52] U.S. Cl. ..... 112/227; 112/165

[58] Field of Search ..... 112/165, 166, 199, 200, 112/227

[56] References Cited

U.S. PATENT DOCUMENTS

| | | | |
|---|---|---|---|
| 712,852 | 11/1902 | Rontke | 112/165 |
| 990,414 | 4/1911 | Weis | 112/200 |
| 1,137,783 | 5/1915 | Onderdonk | 112/166 X |
| 1,244,921 | 10/1917 | Thompson | 112/165 |
| 1,433,872 | 10/1922 | Chalman | 112/227 |
| 1,738,644 | 12/1929 | Gatchell | 112/227 |

*Primary Examiner*—Wm. Carter Reynolds

[57] ABSTRACT

A needle protector for sewing machines operatively connected to the machine's horizontal shaft for driving its looper in an orbital pathway about the machine's needles. The horizontal shaft is simultaneously driven through oscillating and reciprocating movements. The needle protector is carried on a pivotable support and the reciprocating movement of the horizontal shaft is effective in moving the needle protector toward and away from the needles in timed sequence with the stitch forming cycle.

2 Claims, 7 Drawing Figures

NEEDLE PROTECTOR FOR SEWING MACHINES

BACKGROUND OF THE INVENTION

The invention pertains to a needle protector for sewing machines of the double chain stitch type in which the looper is caused to travel about the needles in a substantially elliptical pathway.

This needle protector is of the movable type and is actuated downstream of the needles by being operatively connected to one of the two movements which together effect orbital travel of the machine's looper.

The movable needle protector element according to the invention is carried on a bracket member which is pivotably connected to a fixed support element mounted in the base of the machine and is provided with connecting means operatively associated with the looper so that said movable needle protector element is caused to move into close proximity with the needles during the initial movement of the looper at the start of a new stitch.

The invention is applicable to a sewing machine of the double chain stitch type and, more particularly, to a machine having a reciprocating needle bar with at least one needle and at least one looper cooperating with the needle to form stitches. Actuating means are provided which cause the looper to reciprocate transversely of the direction of travel of a workpiece being sewn and simultaneously in a direction parallel with the workpiece direction of travel whereby the combination causes said looper to travel in an elliptical pathway. These machines also include a transport device having at least one feed dog that functions during seaming and downstream therefrom and operatively associated therewith has a needle protector element which serves to maintain the operating phase positions constant between the needle and the looper during the formation of each stitch.

Sewing machines of the type described have the looper and its associated support element mounted on a looper shaft which is operatively connected to the actuating means referred to above for causing said looper to perform its intended function. This so-called looper shaft can be subjected to oscillatory motion about its axis which is perpendicular to the direction of workpiece advance and to simultaneously subject the looper to movement parallel to the direction of workpiece advance. The sole portion of the looper support is acted upon by means such as occurs in the Rimoldi Class 264 sewing machines. The looper shaft can also be acted upon so that it oscillates about its axis and simultaneously translates along the same axis such as occurs in the Rimoldi Class 183 sewing machines. In both classes of machines, the needle protector is caused to reciprocate forwardly and rearwardly in a direction parallel with the advance of a workpiece during seaming and its movement is commonly accomplished by the feed dog to which it is operatively connected. The linkage between the needle protector element and the feed dog is determined by the fact that the rearward displacement of the feed dog is in the same direction as that which the needle protector has to be moved to approach the needle in timed sequence with movement of the looper into close proximity with the needle. Such linkage is also determined by the fact that a portion of the feed dog is disposed downstream of the needle whereat it is adapted to support the needle protector element.

Although the synchronization of movements of the feed dog and the needle protector element connected thereto as well as the looper are such that these elements perform their intended functions as desired. The linkage between said feed dog and needle protector element is responsible for what is considered a very undesirable condition. This condition presents itself when it is desired to change the length of the stitches being formed, for any such change, it is necessary to adjust the relative position of the needle protector element to maintain unchanged the stroke position of the needle relative to the looper. Additionally, and as is well known to those conversant in the art, the feed dog is subjected to a reciprocating motion which has no means for counteracting for variations in the movement of said feed dog and which is accentuated with increases in sewing machine speed. This deficiency of the transport device in general is greatly accentuated when the needle protector element is fixedly attached to the feed dog.

SUMMARY OF THE INVENTION

The movable needle protector for sewing machines according to the invention eliminates the above disadvantages by disengaging it from its conventional operating connection with the feed dog and without adding additional driving elements to this portion of the machine utilize other existing driven elements to effect the desired movement of said needle protector.

It is a general object of the invention to operatively connect the movable needle protector to the machines looper drive in a manner whereby it will be moved to a position of close proximity with the needle by the same motion which moves the looper into operative association with the needle.

A significant advantage provided by the invention is that of having substantially reduced the weight of the moving parts of the feed dog forming a part of the machine's transport device and obtaining the necessary synchronization of motion between the needle protector and looper independently of the conventional drive elements that are subject to timing adjustments.

A further advantage is that of utilizing the constant motion of approach of the looper to obtain the same motion for the needle protector means which should remain constant. Other objects and advantages of the present invention will become more fully apparent by reference to the appended claims and as the following detailed description proceeds in reference to the figures of drawing wherein:

DESCRIPTION OF THE PREFERRED EMBODIMENT

Figure 1:
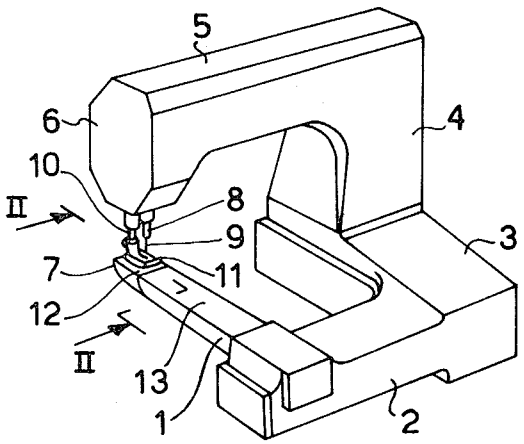
FIG. 1 is a prospective view of one type of sewing machine to which the invention is applicable.

Referring now to FIG. 1, the present invention will be described applied to a double chain stitch sewing machine having a U-shaped support structure formed by a displaced base 1 attached in a projecting manner on a first arm 2 of a support defining a second arm 3. An upright 4 is vertically mounted on the second arm 3 and supports at its upper end a horizontal arm 5 having a free end 6 disposed above and in alignment with the free end of the displaced base 1 that is identified by numeral 7. Within the free end of the horizontal arm 5, a conventional needle bar 8 is supported for reciprocating movement and has one or more needles mounted in a known manner on the lower end thereof which are identified by numeral 9. The machine includes the usual form of presser bar 10 reciprocably mounted within the end 6 of the horizontal arm 5 and carries at its lower end a conventional presser foot 11. This presser foot 11 cooperates in a well known manner with the machine's needle plate 12 that is conventionally mounted to the work supporting surface 13 of the displaced base 1.

The type of sewing machine described supra is commercially known as feed-off-the-arm type or of the "Rimoldi Class 183" type machine and the line of transport or direction of travel of a workpiece being sewn extends from the end 7 of the displaced base 1 in a manner whereby the pathway of travel of said workpiece is parallel to the longitudinal axis of said displaced base 1.

The number of needles 9 this machine is capable of using and the particular configuration of its base structure are characteristics which should not be considered to restrict the present invention for the latter is applicable to any sewing machine which is capable of forming a double chain stitch by means of the concatenation of the thread carried by the needle with that carried by the looper which travels in an orbital pathway about the needle as is known and which will be further described hereinafter.

Figure 3:
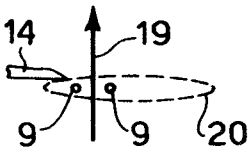
FIG. 3 is a schematic view showing the elliptical pathway followed by the looper and the direction of advance of a workpiece.
Figure 2:
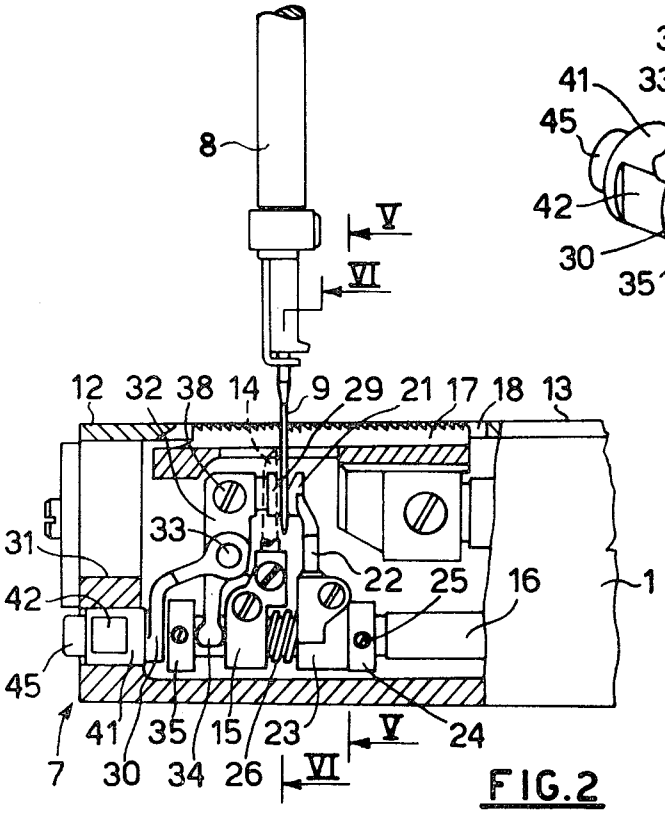
FIG. 2 is a view in side elevation and partially in section as seen looking in the direction of the indicating arrows of line II—II in FIG. 1.

Referring now to FIG. 2, the looper is identified by reference numeral 14 and is shown by dotted lines to more clearly show its operating position. This looper 14 is mounted on a conventional looper support 15, which is assembled on a horizontally extending shaft 16 that performs its function within the displaced base 1 in a manner whereby its end is disposed in the area beneath the needle plate 12 which is located adjacent the free end of said displaced base 1. The feed dog 17 forms a part of the usual workpiece transport device in this area of the sewing machine and as is well known, its function causes it to periodically protrude through slots 18 provided in the needle plate 12. Actuation of the feed dog 17 determines the direction of movement or line of transport of the workpiece being sewn and is depicted in FIG. 3 by an indicating arrow 19. The type of sewing machine shown and described herein is provided with a well known actuating means (not shown) which is effective on the shaft 16 to cause the latter to oscillate about its longitudinal axis and simultaneously to reciprocate along this same axis. The combination of this oscillating and reciprocating movement causes the looper to travel in the desired synchronized movement with the needles along an orbital pathway described above and which is shown and identified in FIG. 3 by numeral 20. Movement along this orbital pathway first causes the looper 14 to pass rearwardly of the needles 9 which is downstream of them relative to the line of transport 19 and to pass through the latter in a substantially perpendicular direction to seize the usual thread loop carried by each needle when the needles are displaced upwardly. This movement then causes the looper 14 to pass in front of the needles 9 which is upstream of them by means of the longitudinal displacement of the shaft 16 parallel to the line of transport 19, while the needles are raised so as to complete the formation of the stitch.

There is usually provided in the zone in which the stitches are formed a conventional movable member which acts on the needles 9 as a loop pusher element 21, i.e., it serves to maintain unchanged both the position of each needle with respect to the looper and the amount of thread forming the loop to be taken by the looper. The loop pusher element 21 is disposed upstream of the needles 9 and is provided with a planar surface adjacent the looper 14 and includes a depending tail portion 22 the lower end of which is assembled in a bushing 23 that is freely mounted on the shaft 16.

There is provided between the loop pusher 21 and the internal face of the looper 14 a sufficient space to permit free passage of the needles 9 during their initial movement to form each stitch when the looper 14 is displaced downstream of the needles by the motion of the shaft 16 to seize a loop of thread and simultaneously the loop pusher element 21 is displaced with solidarity toward the needles by the looper carrier.

For this purpose, the bushing 23 of the loop pusher element is held in position by a collar 24 conventionally fixed on the shaft 16 by a screw 25 and by means of a coil spring 26 interposed between the bushing 23 and the looper support 15, a biasing force is provided for maintaining contact of said bushing with the collar 24.

Figure 6:
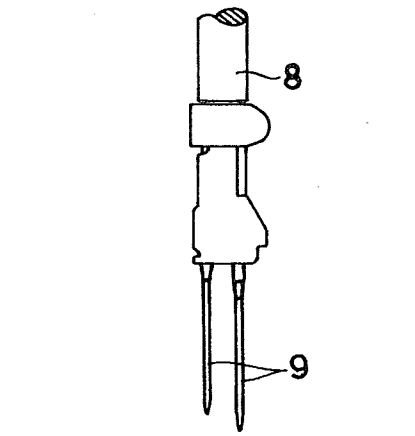
FIGS. 5 and 6 are sectional views taken along lines V—V and VI—VI in FIG. 2 respectively.
Figure 5:
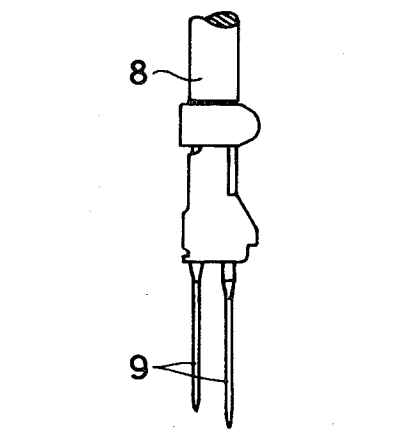

To prevent rotation of the loop pusher element 21 on the shaft 16, the bushing 23 is provided with an integrally formed and laterally extending arm 27 (FIGS. 4 and 5) the free end of which is slidably guided within a channel 28 formed in the internal wall of the displaced base 1.

Figure 4:
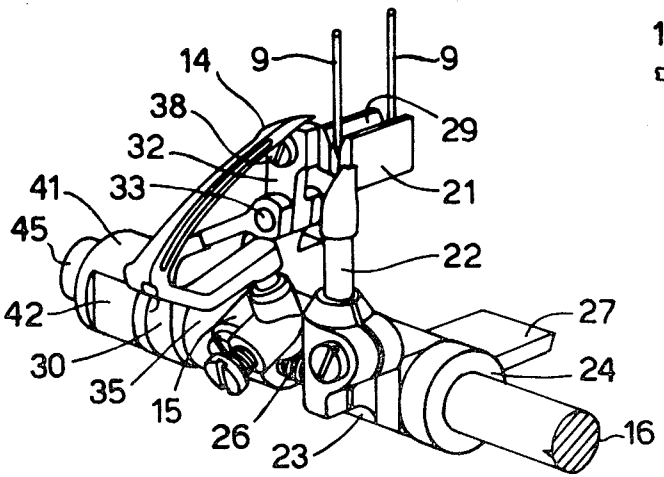
FIG. 4 is a perspective view of the various elements which operate in that area of the sewing machine shown in FIG. 3.

As shown in FIGS. 2 and 4, the sewing machine is provided with an additional movable member disposed in opposed relation to the loop pusher element 21 and serves as a needle protector identified in these figures of drawing by numeral 29. This needle protector 29 during the performance of its intended function prevents displacement or flexing of the needles in the direction of advance of a workpiece so as to prevent damaging interference with the looper during the initial stroke to form each stitch. This needle protector element 29 is disposed downstream of the needles 9 and is reciprocally movable toward and away from said needles and is moved into contact with the latter at the same time that the looper is caused to move into operative association with the needles for the purpose of taking the thread loops carried thereby.

The type sewing machine shown in the drawings has the movable needle protector 29 assembled on a support means mounted within the displaced base 1 in alignment with the shaft 16. This support means defines a stationary support member 30 mounted in the end wall 31 (FIG. 2) of the displaced base 1 and by an oscillatable support element 32 which is pivotably attached as at 33 to said stationary support member 30. This oscillatable support element 32 has the needle protector 29 assembled thereon and is disposed in overlying relationship with the end portion of shaft 16. The oscillatable support element 32 is provided with depending extensions that extend in the direction of the shaft 16 and the lower ends define connection means that are adapted to be operatively influenced by the movements of the looper about the needles 9. This connecting means defines a pair of parallel, spaced apart depending arms 34 that straddle the shaft 16 and with their lower ends being in operative engagement with the looper support 15 (FIG. 2) which is displaced by the looper when the latter is moved from its position downstream of the needles toward its upstream position where it approaches them to initiate a new stitch. Because the movement of the looper is in a direction opposed to that required by the needle protector element, the oscillatable support element 32 has been provided in the form of a pendulum pivotably supported intermediate its ends and with said needle protector element mounted on one end and the opposite end defining the depending arms 34. As is shown in FIG. 2, a sufficient amount of clearance is provided between the stationary support member 30 and the end of the shaft 16 so as to permit the latter to be displaced as required to effect actuation of the looper and needle protector. To effect movement of the needle protector 29 away from the needles, the reverse motion of the shaft 16 is utilized and is accomplished by means of a collar 35 fixed on the end of said shaft so as to engage the sides of the depending arms 34 opposite their engagement with the looper support 15. It should be obvious that the successive movements for actuating the looper 14 with respect to the needles are at the appropriate time of the stitch forming cycle so as to be effective in actuating the needle protector 29.

Figure 7:
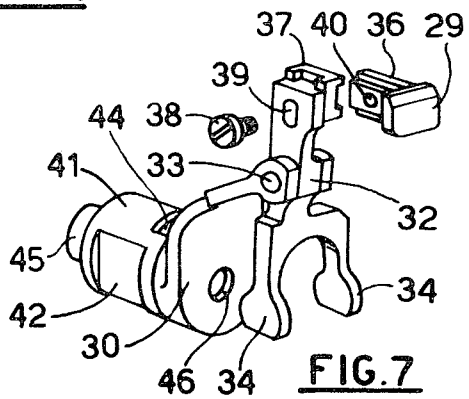
FIG. 7 is a perspective view partially exploded showing the movable needle protector according to the invention.

Referring now to FIG. 7, the needle protector 29 is provided with a laterally extending support arm 36 which is adapted to adjustably assemble to a guide element 37 carried on the upper end of the oscillatable support element 32.

A screw 38 serves to assemble the needle protector 29 to the oscillatable support 32 by causing said screw to extend through a slotted opening 39 in the latter and with the threaded portion thereof assembled in a threaded hole 40 provided in the support arm 36.

The combination of elements described above permits precise positioning of the needle protector element 29, with respect to the needles. The needle protector 29 is mounted on supports that are carried within the base of the machine and is no longer operatively associated with the machine's feed dog. The stationary support member 30 is connected to the end wall 31 of the displaced base 1 by means of a bushing 41 having a planar surface 42 which enables it to be locked in position by a set screw 43 assembled in the side of the displaced base 1. More precisely the stationary support member 30 has a cylindrical portion not shown which assembles within the bushing 41 and by means of a screw 45 extending through an opening in the end of said bushing 41 and with the threaded portion thereof assembled in a threaded hole 46 in said stationary support member, the latter is fixedly positioned and provides a means whereby the entire needle protector assembly can be adjusted in height as desired.

It should be understood that the needle protector 29 can be easily modified for application to other models of sewing machines so that it would be mounted in the base of the machine and would be actuated by the looper that orbits about the needles or by the support for said looper. It should also be understood that such a needle protector could be actuated by a looper support which oscillates with respect to the looper carrier rather than by a support which moves with it as in the type herein described.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. A sewing machine of the double chain stitch type having a feed dog and presser foot for advancing a workpiece and a reciprocating needle bar with at least one needle carried thereby and at least one looper operatively connected to a horizontal shaft simultaneously driven within the machine base through reciprocating and oscillating movements to effect movement of the looper in an elliptical pathway about the needle, said sewing machine comprising:

(a) a looper support 15 fixedly mounted on and for movement with the horizontal shaft within the machine's base;

(b) a loop pusher element 21 disposed upstream of the needle 9;

(c) an oscillatable support element 32 operatively associated with said looper support 15 to support a needle protector 29 on the upper end of said oscillatable support element 32 and move the needle protector toward and away from operative association with the needle during the reciprocating movement of the horizontal shaft, said oscillatable support element 32 having a lower end that defines a pair of spaced depending arms 34 between which the horizontal shaft extends; and (d) said needle protector 29 being disposed downstream of the needle 9 and mounted on the upper end of oscillatable support element 32 for preventing a variance in the operating phase between the needle and looper during the formation of each stitch and the displacement of the needle in the direction of advancing the workpiece.

2. The sewing machine according to claim 1 wherein one side of said depending arms 34 are in operative engagement with said looper support 15 and the opposite sides with a collar 35 fixed on the end of the horizontal shaft.

* * * * *

UNITED STATES PATENT AND TRADEMARK OFFICE

CERTIFICATE OF CORRECTION

PATENT NO. : 4,438,717

DATED : March 27, 1984

INVENTOR(S) : Minella et al.

It is certified that error appears in the above—identified patent and that said Letters Patent is hereby corrected as shown below:

On the face of the patent at [73] Assignee:

Delete 'Rockwell International Corporation, Pittsburgh, Pa.' and

Insert --Rockwell-Rimoldi S.p.A., Italy--

Signed and Sealed this

First Day of October 1985

[SEAL]

*Attest:*

*Attesting Officer*

DONALD J. QUIGG

*Commissioner of Patents and Trademarks—Designate*